United States Patent [19]

Gross

[11] 4,270,070

[45] May 26, 1981

[54] TRAVELING WAVE TUBE

[75] Inventor: Franz Gross, Lörrach, Fed. Rep. of Germany

[73] Assignee: Siemens Aktiengesellschaft, Berlin & Munich, Fed. Rep. of Germany

[21] Appl. No.: 73,722

[22] Filed: Sep. 10, 1979

[30] Foreign Application Priority Data

Sep. 28, 1978 [DE] Fed. Rep. of Germany ..... 2842255

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 2,806,170 | 9/1957 | Bianculli | 315/3.5 |
| 3,070,725 | 12/1962 | Lee et al. | 315/3.5 |
| 3,107,312 | 10/1963 | Kennedy | 315/3.5 |
| 3,271,615 | 9/1966 | Washburn, Jr. | 315/3.5 |
| 3,274,429 | 9/1966 | Swiadek | 315/3.6 |
| 3,293,478 | 12/1966 | Winkler | 315/3.5 |
| 3,374,388 | 3/1968 | Huber | 315/3.5 |
| 3,634,723 | 1/1972 | Gross | 315/3.6 |

*Primary Examiner*—Saxfield Chatmon, Jr.
*Attorney, Agent, or Firm*—Hill, Van Santen, Steadman, Chiara & Simpson

[57] ABSTRACT

A traveling wave tube has a helix or ring-bridge delay line arranged within a vacuum envelope and a plurality of dielectric holding rods parallel to each other for supporting the delay line. The vacuum envelope has an axial longitudinal groove intermediate between two holding rods, and a pressure element located within the groove presses, by way of a tension plate, the holding rods against receiving surfaces provided in the interior of the vacuum envelope, whereby the holding rods are in good mechanical and heat-conducting relationship with the envelope.

7 Claims, 1 Drawing Figure

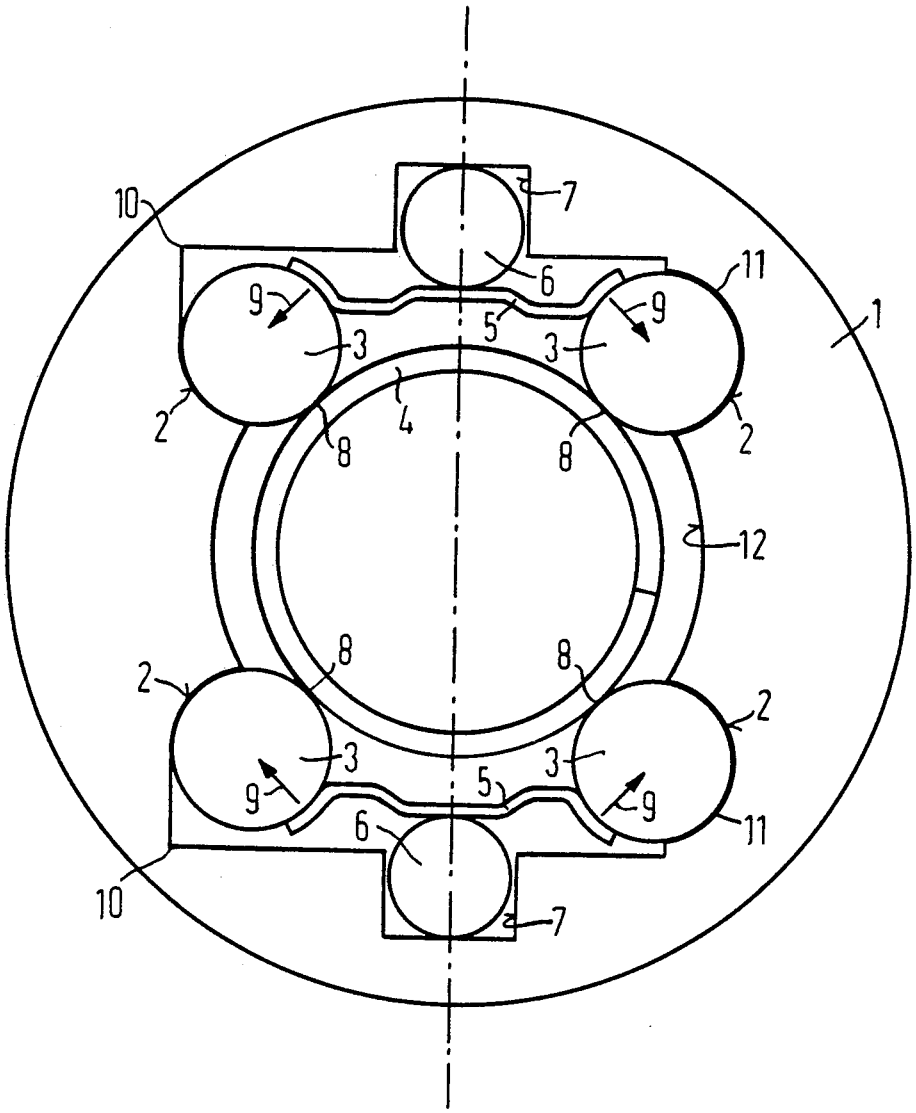
10
7
6
11
9
9
5
1
3
3
2
4
2
8
8
12
8
8
2
2
3
3
9
5
9
6
11
10
7

TRAVELING WAVE TUBE

FIELD OF THE INVENTION

The present invention relates to a traveling wave tube and more particularly to a traveling wave tube employing a helix or ring-bridge delay line.

THE PRIOR ART

Traveling wave tubes having a helical delay line are known from the German Pat. No. 1,937,704. Such tubes have a massive metallic vacuum envelope and a plurality of dielectric holding rods arranged parallel to one another, the holding rods being fixed in their lateral position by means of a shaped interior cross section of the vacuum envelope. The holding rods are in good thermal contact with the vacuum envelope for the purpose of heat dissipation.

It is highly desirable in such traveling wave tubes to provide a firm, but elastic support of the helix, and to provide for a good heat dissipation from the helix to the vacuum envelope. For this purpose, a construction has been proposed which provides a recess in the vacuum envelope parallel to and behind at least one of the holding rods, with a spring inserted into the recess which presses the holding rod into the helix, in such a manner that a direct thermal contact exists between the holding rod and the vacuum envelope of the tube.

Ring-bridge structures are advantageously employed in pulse tubes, which allow a large gain and at the same time have a wide band width. Particularly at high outputs, however, the dissipation of heat from the delay line to the vacuum envelope is an important problem. Especially when copper is used for the delay line, the pressure resulting from the force of the spring can deform the soft copper line. In order to prevent the deformation of the copper delay line, a complicated shaping of the dielectric supports has been proposed, such that the dielectric supports are formed as segments of an annulus in cross section, a process which is relatively difficult, especially when the dielectric supports are formed of beryllium oxide.

BRIEF DESCRIPTION OF THE INVENTION

It is a principal object of the present invention to provide a traveling wave tube which has good heat dissipation from the delay line to the vacuum envelope, and also provides a firm, but elastic support of the delay line without deforming it, even when the delay line is formed of ductile material.

In accordance with one embodiment of the present invention, an axial longitudinal groove is provided in the vacuum envelope between two of the dielectric holding rods, and a pressure element is located in the groove which presses the two holding rods into support by means of a tension plate pressing laterally against the holding rods, the supports being provided in the vacuum envelope.

In one embodiment, the holding rods are soldered to the delay line, and the pressure element is a metal cylinder consisting of non-ferromagnetic material, with the tension plates being formed of tungsten.

When the present invention is used, the delay line can consist of ductile material such as copper, because the forces acting through the holding rods do not pass on to the delay line, but are absorbed by the supports provided in the vacuum envelope. The dielectric holding rods are firmly pressed against the support, into good mechanical and heat-conducting contact. There is, therefore, a good heat conductance between the copper delay line and the vacuum envelope, through the dielectric holding rods.

BRIEF DESCRIPTION OF THE DRAWING

Reference will now be made to the accompanying drawing, which illustrates a top view of a traveling wave tube constructed in accordance with one embodiment of the invention.

DESCRIPTION OF THE PREFERRED EMBODIMENT

In the drawing, two alternative embodiments of the present invention are shown, one on the left-hand side of the drawing, and the other on the right-hand side. A delay line 4, in the form of a helix or ring-bridge line is supported in axial symmetry with a massive metallic vacuum envelope 1, which is preferably formed of copper. The delay line 4 is held in place by means of a plurality of holding rods 3, which are arranged parallel to each other adjacent the line. The holding rods 3 are preferably formed of beryllium oxide or aluminum oxide. An axial longitudinal groove 7 is provided in the interior surface of the vacuum envelope, midway between two adjacent holding rods 3, and a pressure element 6 is located in this groove. The pressure element is preferably a metal cylinder consisting of non-ferromagnetic material. A tension plate 5 is disposed intermediate the holding rods 3 and the pressure element 6, and presses laterally against the holding rods. The holding rods 3 are urged into contact with cylindrical supporting surfaces provided in the interior of the vacuum envelope 1.

The holding rods 3 may be soldered to the delay line 4 at locations 8. The arrows 9 indicate the direction of forces acting between the tension plate 5 and the holding rods 3. The interior cross section of the vacuum envelope comprises essentially a quadrangle having supports 2 located at its corners, for accepting the holding rods 3. In the arrangement shown in the left-hand side of the drawing, the recesses which receiving the holding rods 3 are provided with rectangular interior edges 10, while in the arrangement illustrated in the right-hand side of the drawing, circular cylindrical surfaces 11 are provided extending about a greater portion of the periphery of the holding rods 3.

From the foregoing, it will be apparent that the present invention offers a simple and effective means of supporting a delay line within the interior of a traveling wave tube, in such a way as to promote good heat conduction between the dielectric supporting rods and the vacuum envelope of the tube, without exerting any substantial forces on the delay line itself.

It will be apparent to those skilled in the art that various modifications and additions may be made in the apparatus of the present invention without departing from the essential features of novelty thereof, which are intended to be defined and secured by the appended claims.

What is claimed is:

1. A traveling wave tube having an interior delay line housed within a vacuum envelope, a plurality of dielectric holding rods arranged parallel to one another and soldered to said delay line for supporting said delay line, said vacuum envelope having surfaces for receiving and locating said holding rods in good thermal contact therewith, said vacuum envelope having a longitudinal groove arranged between two of said holding rods and parallel thereto, a pressure element received within said groove, and a tension plate interposed between said pressure element and said two adjacent holding rods, for pressing said holding rods laterally against said surfaces, without exerting pressure on said delay line.

2. The traveling wave tube according to claim 1, wherein said delay line is helical and wherein said tension plate engages each of said holding rods at a point where the surface of said rod is approximately radial relative to the center line of said helical delay line, and wherein each said rod engages its said surface at least at a point where said surface is approximately radial relative to the center line of said helical delay line.

3. The traveling wave tube according to claim 1, wherein said delay line is helical and wherein said tension plate engages each of said holding rods at a point directly opposite a point where said holding rods are pressed against said surfaces.

4. The traveling wave tube according to claim 1, wherein said delay line is formed of copper.

5. The traveling wave tube according to claim 1, wherein said pressure element is a metallic cylinder consisting of non-ferromagnetic material.

6. The traveling wave tube according to claim 1, wherein said tension plate is formed of tungsten.

7. The traveling wave tube according to claim 1, wherein the interior cross section of said vacuum envelope comprises a guadrangle, said quadrangle having one of said surfaces in each of its corners.

* * * * *